US006073316A

United States Patent [19]

Ferrario et al.

[11] Patent Number: 6,073,316

[45] Date of Patent: Jun. 13, 2000

[54] WATCHSTRAP CLASP

[75] Inventors: Luigi Ferrario, Hauterive; Jacques Hubert Gay, Vandoeuvres-Geneve, both of Switzerland

[73] Assignee: Montres Rolex S.A., Geneva, Switzerland

[21] Appl. No.: 09/029,820

[22] PCT Filed: Mar. 14, 1996

[86] PCT No.: PCT/CH96/00096

§ 371 Date: Mar. 18, 1998

§ 102(e) Date: Mar. 18, 1998

[87] PCT Pub. No.: WO96/31138

PCT Pub. Date: Oct. 10, 1996

[30] Foreign Application Priority Data

Apr. 4, 1905 [CH] Switzerland ..... 962/95

[51] Int. Cl.[7] ..... A44C 5/24

[52] U.S. Cl. ..... 24/71 J; 24/71 R

[58] Field of Search ..... 24/68 J, 69 J, 24/70 J, 71 J, 265 WS, 265 BL, 68 T, 68 E, 265 B, 616, 625; 224/174, 175, 176

[56] References Cited

U.S. PATENT DOCUMENTS 2,532,840 12/1950 Gaun ..... 24/71 R
5,331,723 7/1994 Mathieu ..... 24/71 J
5,689,859 11/1997 Cuche ..... 24/71 J
5,857,243 1/1999 Champion ..... 24/71 J

FOREIGN PATENT DOCUMENTS 661609 11/1951 United Kingdom ..... 24/71 J

*Primary Examiner*—Anthony Knight
*Assistant Examiner*—Robert J. Sandy
*Attorney, Agent, or Firm*—Walter C. Farley

[57] ABSTRACT

A clasp fastener having a clasp (1) is designed to be snapped into engagement by exerting a closing force. A locking device (4) for locking the clasp (1) is placed by the closing force in an engaged position in which it is in a first snap engagement with a locking projection (6), and a closing member (5) for closing the clasp (1) is fixed by the closing force in a safety position in which it is in a second snap engagement with the locking device (4) so that the snapping force of the first engagement of the clasp (1) with the locking projection (6) is increased. At least one variable-diameter pin (17,18) that is flexible and/or has different diameters allows some movement of the locking device (4), so that the effective closing force exerted on the locking projection (6) is reduced.

12 Claims, 6 Drawing Sheets

WATCHSTRAP CLASP

FIELD OF THE INVENTION

This invention relates to fasteners and more particularly to a safety clasp fastener for a watch strap or bracelet.

BACKGROUND OF THE INVENTION

Usually, straps of wrist-watches are opened and fastened by using known fastener devices like a buckle or a clasp. The application of one of these fastener devices depends often on the material from which the watch strap is made. For example, a watch strap made from soft material like leather is fastened by actuating a buckle. By contrast, a watch strap made from rigid or metallic material is often fastened by snapping a clasp.

A watch strap having a buckle is fastened in several stages. First, an end portion of the watch strap is inserted into a first loop, then a tongue of the buckle is engaged in a strap hole and finally the buckle is fixed by inserting the end portion of the watch strap into a second loop of the buckle. The end portion is secured by sliding its end in a guide loop of the watch strap. A watch strap having a clasp, by contrast, is snapped in one or two stages by fixing the clasp to a stud of the watch strap.

Hereinafter, discussion will be limited to the advantages and disadvantages of a clasp fastener of a watch strap.

A clasp fastener is generally provided with an adjusted closing force. Usually, the closing force is regulated during manufacture and is adjustable by a specialist during maintenance of the watch strap. This force can differ in function of the watch strap model chosen. Models destined for male or sporting users are activated with a closing force higher than that of a model destined for female users. One disadvantage is that the closing force of a watch strap clasp cannot be regulated by users as a function of daily or leisure activities.

A clasp fastener which is not provided with a security device for securing its fastening procedure, can, in accordance with the strength of the closing force, open as the result of a heavy shock, for example during a sport activity. One disadvantage is that a watch strap clasp having no security device cannot prevent unintentional fastener opening.

SUMMARY OF THE INVENTION

An object of the invention is to provide a clasp fastener with general application, for example for a wrist-watch, which has a particularly compact construction and is compatible with known, proven manufacturing methods.

According to the invention, this object is achieved by a clasp fastener with a completely novel concept. The clasp fastener is made from elements which allow positioning and securing or safety engagement of the clasp and which allow individual regulation of the closing force.

By a latching force, in a first stage, a locking device of the clasp carries out a positioning closure, i.e., the actuation of the locking device allows its positioning against a locking projection of the clasp (first snap engagement). In a second stage, a security cover of the clasp carries out a securing closure, i.e., the clasp is fixed by the securing cover (second snap engagement), increasing therefore the latching force of the first snap engagement of the clasp with the locking projection.

Moreover, one or more variable-diameter pins of the locking device are provided, these pins having spring characteristics and/or different diameters for allowing some movement or clearance relative to one or more locking elements of the locking device, reducing therefore the closing force effectively exerted on the locking projection and allowing individual regulation of the closing force.

Finally, the securing cover is mounted in a detachable manner about an axis of articulation of a hinge. One or more locking elements having straight and rigid portions constitute a resisting axis, which axis resists closure of the security cover in a closure plane. The one or more locking devices are adjustable with respect to the hinge, so as to be able to vary the mutual distance from the straight and rigid portions to the hinge for increasing or reducing the resisting force. This resisting force resists the securing closure of the security cover on the locking device, allowing individual regulation of the latching force.

BRIEF DESCRIPTION OF THE DRAWINGS

The characteristics and advantages of the invention will be better understood from the following description with reference to several preferred embodiments, shown in the attached drawings, wherein.

DESCRIPTION OF PREFERRED EMBODIMENTS

Figure 1A:
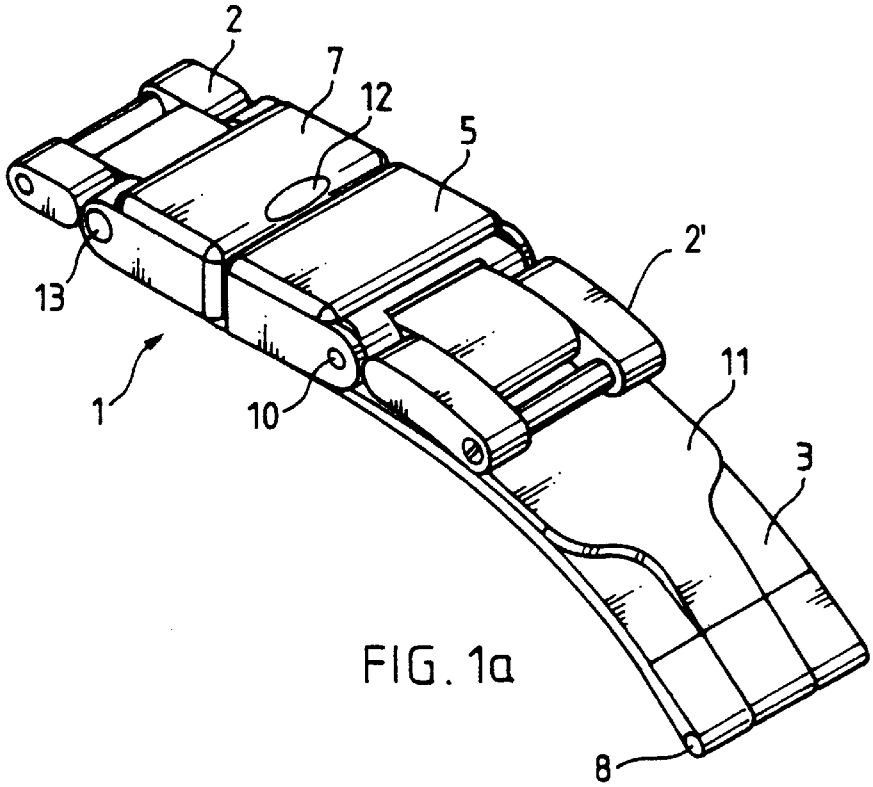
FIGS. 1*a* and 1*b* are perspective views of a preferred embodiment of a clasp fastener.
Figure 1B:
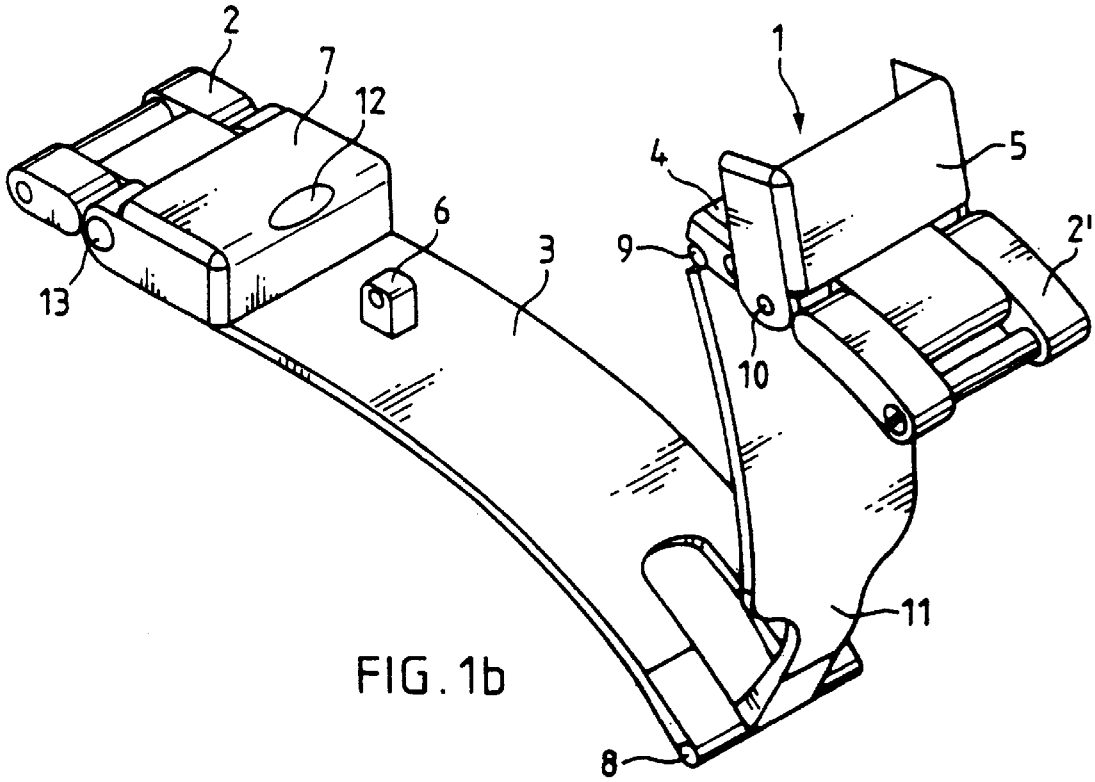
Figure 2:
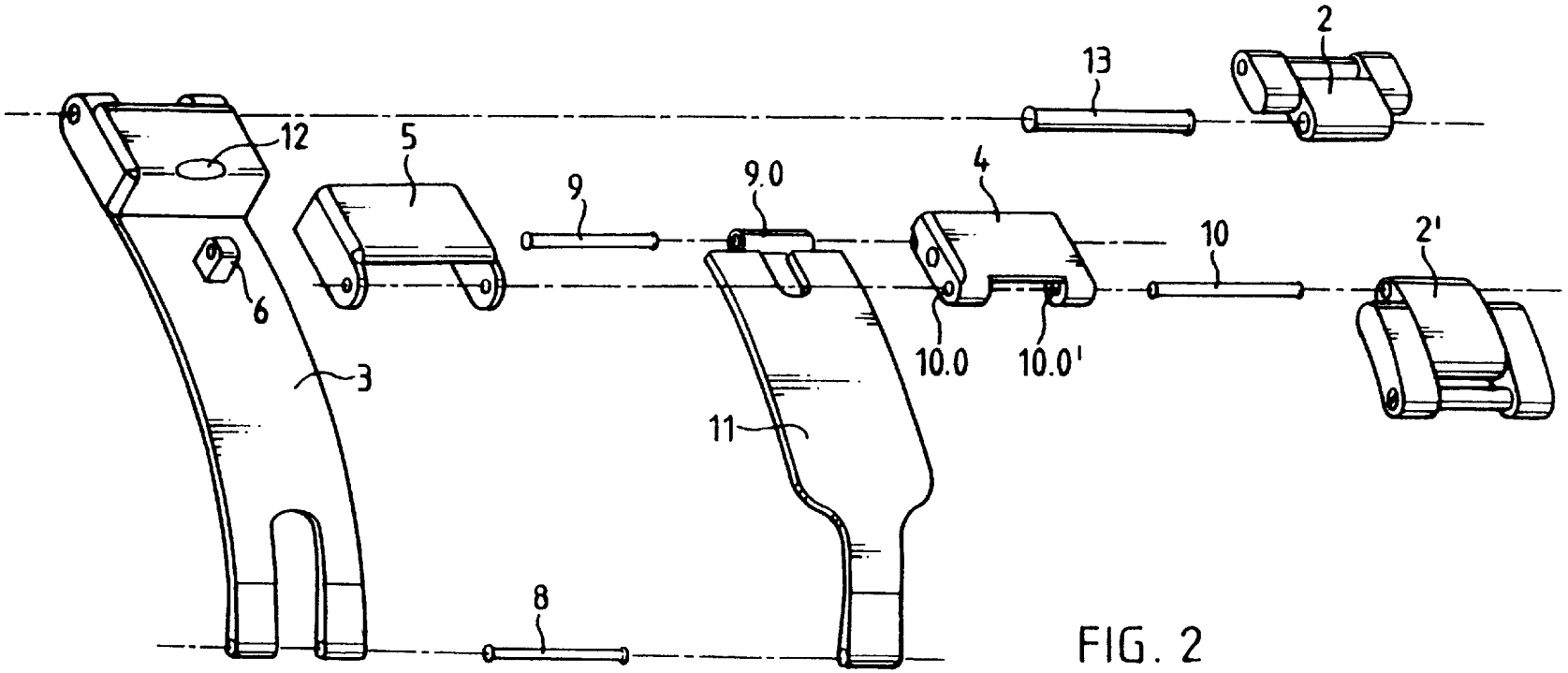
FIG. 2 is a perspective, exploded view of the preferred embodiment of a clasp fastener according to FIGS. 1*a* and 1*b;*

FIGS. 1*a* and 1*b* show a preferred embodiment of a clasp fastener, for example for a wrist watch, in a perspective view with a watch strap, in a closed state (FIG. 1*a*) and in an open state (FIG. 1*b*). FIG. 2 is a perspective, exploded view of the elements of the clasp fastener. The watch strap and the visible elements of the clasp fastener are preferably made from metal. They are, for example, constructed from stainless steel and/or gold. The partial views according to FIGS. 1*a*, 1*b* and 2 essentially show a clasp fastener, final links 2, 2' of the strap, a lower or base strip 3 of the clasp, a locking projection 6 mounted, for example by welding, on lower strip 3 of the clasp, a joining piece 7 which acts as a terminal connection element of the clasp, an upper strip 11 of clasp 1 and a locking device 4 provided with a securing cover 5 of clasp 1. With the knowledge of the present invention, a person skilled in the art can implement other embodiments of a clasp fastener.

Clasp 1 is mounted in an openable manner about three articulation axes of three rods 8, 9 and 10 forming hinges. Rod 8 forms a hinge which allows articulation between upper strip 11 of clasp 1 and lower strip 3 of the clasp. Rod 9 forms a hinge which allows articulation between locking device 4 and a bushing 9.0 having a guiding function and being fixed to upper strip 11 of clasp 1. Rod 10 forms a hinge allowing articulation between securing cover 5 and locking device 4 and also between locking device 4 and final link 2' of the watch strap or bracelet. Clasp 1 can be latched closed by successive snap engagements of locking device 4 and securing cover 5 with locking projection 6. Completing the description of the visible elements, a rod 13 forms a hinge 13 allowing articulation between joining piece 7 and a final link 2 at the other end of the watch strap or bracelet. The axes of the rods forming hinges 8, 9, 10 and 13 are oriented more or less perpendicular to the general plane of the watch strap and to the opening and closure planes of clasp 1. With the knowledge of the present invention, a person skilled in the art can implement other arrangements of axes of a clasp fastener.

According to one characteristic of the invention, the snapping mechanism of the watch strap clasp fastener operates by means of articulation elements which are activated in two engagement stages in a closure plane of clasp 1. In a first stage, for example, by pressing an end portion of securing cover 5, upper strip 11 of clasp 1 is pivoted relative to final link 2' until upper strip 11 contacts against lower strip 3 of the clasp. At the same time, locking device 4 is pressed against lower strip 3 of the clasp until locking device 4 contacts locking projection 6 which protrudes from lower strip 3 through an opening in upper strip 11 of clasp 1. Locking device 4 is positioned by a first snap engagement against locking projection 6. In a second stage, securing cover 5 is pivoted relative to locking device 4 and pressed against locking device 4. Securing cover 5 is kept on locking device 4 by a second snap engagement. This second snap engagement increases the snapping force of the first snap engagement of clasp 1 with locking projection 6. Clasp 1 according to the invention is, therefore, engaged in a secured closure state. Details concerning these engagements are described in the description of FIGS. 5*a* to 5*c*, 6*a*, 6*b* and 7.

Securing cover 5 is a closure device of the clasp fastener and an adornment piece. The aim is to hide locking device 4 under securing cover 5. In the closed state of the clasp, securing cover 5 covers and hides locking device 4 more or less completely. Closed clasp 1 with an engaged securing cover 5 has a similar appearance as joining piece 7 and improves appearance. The presence of a crown on the external wall of securing cover 5 leads to a further increase of the very attractive appearance of clasp 1.

The opening mechanism of the closed watch strap clasp is identical to the closure mechanism, the above described two stages simply must be reversed. The opening occurs by actuating locking device 4. According to a preferred embodiment, securing cover 5 is first lifted by placing a thumb or an index finger in a groove or recess 12 in the external wall of joining piece 7 and next to a crown on the external wall of securing cover 5, lifting the cover. With the knowledge of the present invention, a person skilled in the art can implement other arrangements of this kind of clasp fasteners.

Figure 3A:
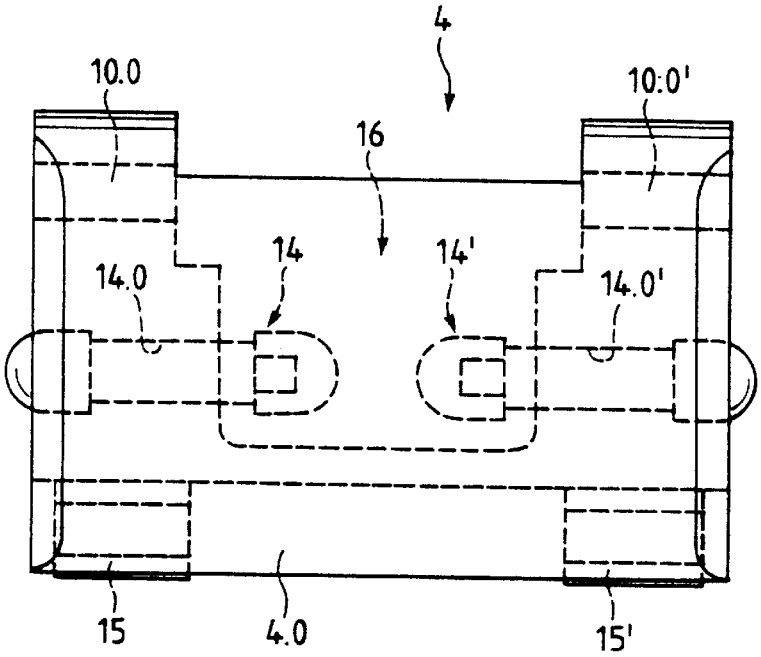
FIGS. 3*a* and 3*b* are front and side elevations of a first preferred embodiment of a locking device of a clasp fastener.
Figure 3B:
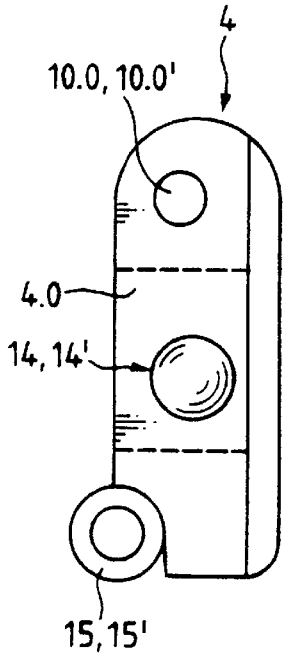
Figure 4A:
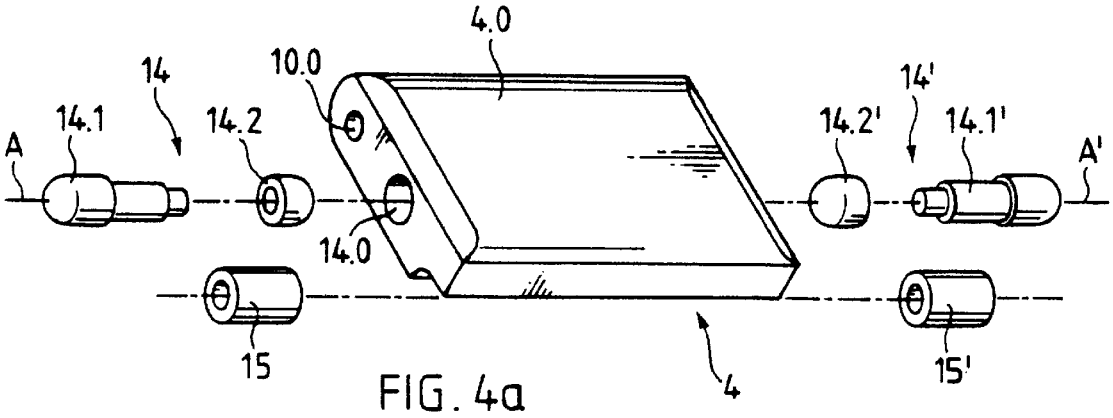
FIG. 4*a* is a perspective, exploded view of the preferred embodiment of a locking device of a clasp fastener according to FIGS. 3*a* and 3*b;*

FIGS. 3*a* and 3*b* show a first preferred embodiment of a locking device 4 of a clasp fastener in a top plan view parallel with a longitudinal plane (FIG. 3*a*) and in a side elevation view showing a lateral profile (FIG. 3*b*). FIG. 4*a* is a corresponding perspective, exploded view. Locking device 4 comprises a case 4.0 with a central notch 16. Case 4.0 has through-holes 14.0, 14.0' forming bushings aligned with each other and having a guide function for keeping axes of two locking elements 14, 14' aligned. Case 4.0 is also penetrated by aligned holes 10.0, 10.0' for receiving rod 10 coaxially with the holes (see the description of FIGS. 1*a*, 1*b* and 2). According to a preferred embodiment, two guide bushings 15, 15' support rod 9 of the hinge previously described in a guide bushing 9.0 welded on upper strip 11 of clasp 1 (see the description of FIGS. 1*a*, 1*b* and 2). With the knowledge of the present invention, a person skilled in the art can implement other arrangements of elements of a clasp fastener. For example, it is possible to realize a clasp fastener having only one locking element.

Figure 5A:
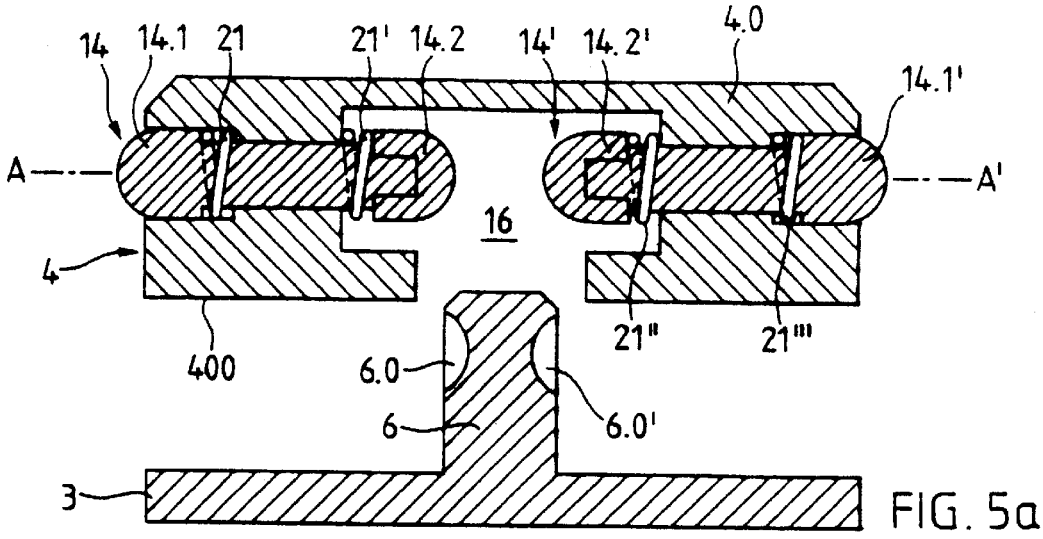
FIGS. 5*a* to 5*c* are sectional views of a preferred embodiment of a clasp fastener according to FIGS. 3*a,* 3*b* and 4 showing different stages of operation of the closure mechanism.
Figure 5B:
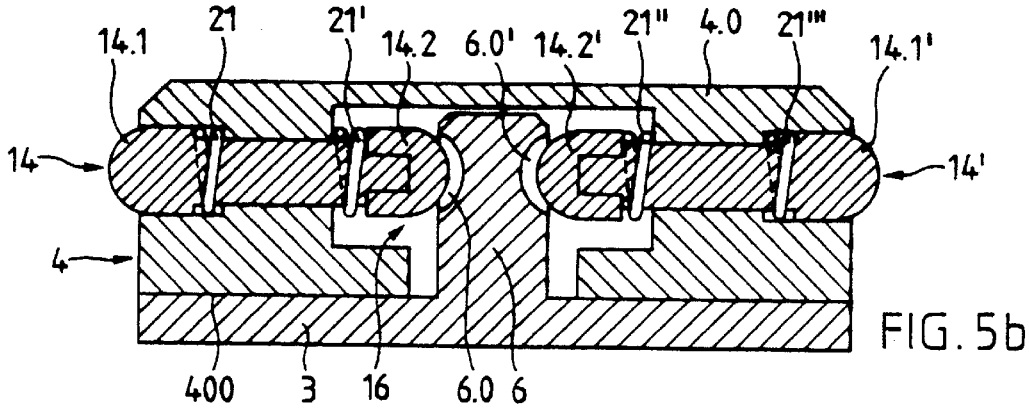
Figure 5C:
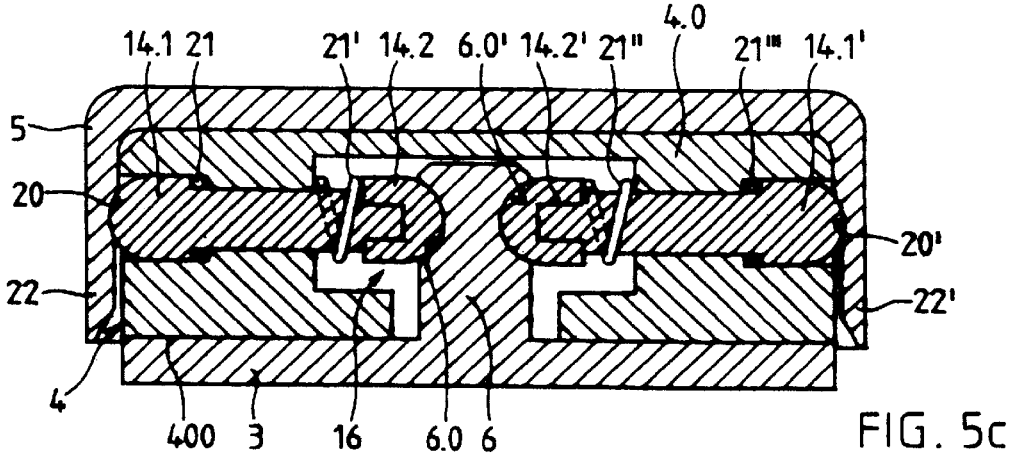

According to the first preferred embodiment of a clasp fastener, the two locking elements 14, 14' are elongated contact bolts having contact forces exerted along an axis AA' (FIG. 4*a*). The locking elements comprise, for example, springs. The contacting force of locking elements 14, 14' is defined by the chosen dimensions (length, diameter, etc.) and by the materials chosen. Each locking element 14, 14' comprises a outer bolt 14.1, 14.1' and an inner bolt 14.2, 14.2'. Outer bolts 14.1, 14.1' are each provided with a rounded and convex portion for contact purposes and with an elongated portion for sliding and pivot purposes. Inner bolts 14.2, 14.2' are each provided with a rounded and convex portion for contact purposes. Outer bolts 14.1, 14.1' and inner bolts 14.2, 14.2' are joined in a way to resist compressive forces along their contact axis AA'. After mounting in case 4.0 of locking device 4, locking elements 14, 14' are guided by holes 14.0, 14.0' having a guidance function and being able to support external pressure exerted on outer bolts 14.1, 14.1' and on inner bolts 14.2, 14.2'. Locking elements 14, 14' are mounted in a detachable manner and with some movement or clearance along their contact axis AA'. Outer bolts 14.1, 14.1' protrude beyond two external walls of case 4.0, while inner bolts 14.2, 14.2' protrude inwardly beyond two internal walls of case 4.0. Thus, end portions of locking elements 14, 14' protrude beyond two external walls of locking device 4 on the side of contact with securing cover 5, while inner end portions of locking elements 14, 14' protrude beyond two internal walls of locking device 4 to make contact with locking projection 6. Once locking device 4 is engaged with locking projection 6, projection 6 is within central notch 16 in engaged contact with locking elements 14, 14'. After engagement of securing cover 5 with locking device 4, walls 22, 22' and recesses 20, 20' of securing cover 5 are in engaged contact with locking elements 14, 14'. A preferred embodiment of a securing cover 5 is shown in FIGS. 5*a* to 5*c*. Details concerning the functioning of locking elements 14, 14' are described with reference to FIGS. 5*a* to 5*c*.

The stages of the closure and opening mechanism in a closure and opening plane of a first preferred embodiment of locking device 4 of a clasp fastener are shown in three different states in FIGS. 5*a* to 5*c*. FIGS. 5*a* to 5*c* are sectional views showing partly a locking projection 6, securing cover 5, and a locking device 4 having two locking elements 14, 14' mounted in two guide holes 14.0, 14.0' which keep the locking elements coaxial, the locking elements 14, 14' each having an outer bolt 14.1, 14.1' and a inner bolt 14.2, 14.2'.

FIG. 5*a* shows a first state of the closure stages. According to one characteristic of the invention, locking projection 6 welded on lower strip 3 of the clasp is provided with two fixing recesses 6.0, 6.0' having concave surfaces. Fixing recesses 6.0, 6.0' serve for snap engagement of the rounded, convex portions of inner bolts 14.2, 14.2'. Preferably, the concave surfaces of fixing recesses 6.0, 6.0' and the convex surfaces of inner bolts 14.2, 14.2' are shaped to match each other, having for example the same radius, allowing optimized contact due to a maximal contact surface between these two elements. With the knowledge of the present invention, a person skilled in the art can implement other embodiments of locking projections.

Figure 4B:
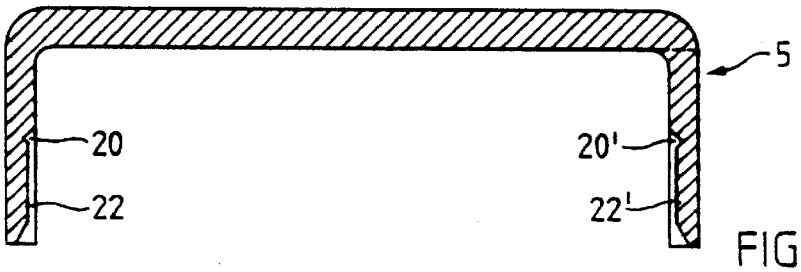
FIGS. 4*b* and 4*c* are sectional views of a preferred embodiment of a securing cover of a clasp fastener according to FIGS. 1*a*, 1*b* and 2.
Figure 4C:
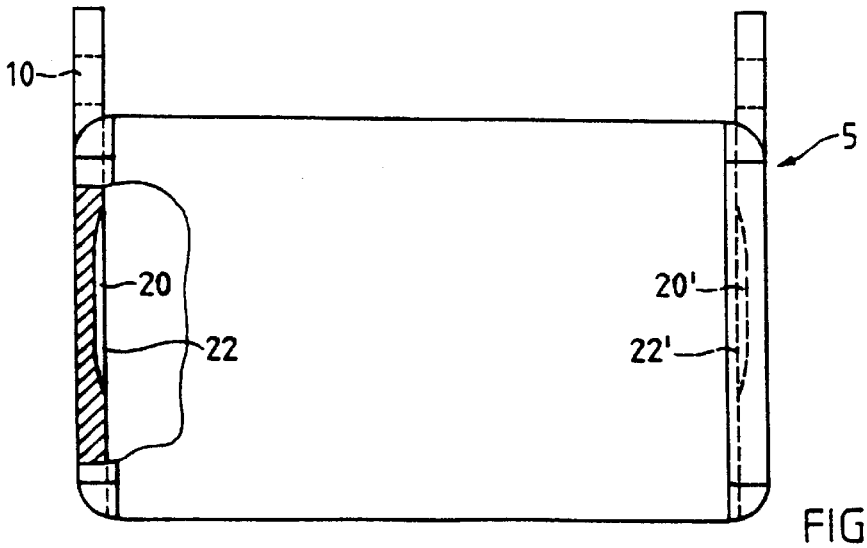

FIG. 5*b* shows a second state of the closure stages wherein locking device 4 is positioned by a first snap engagement with locking projection 6 (first closure stage). Locking device 4 comprises, with reference to FIG. 4, central notch 16 and inner bolts 14.2, 14.2' protrude through internal walls defining central notch 16. Under external pressures, locking elements 14, 14' are axially movable with clearance along their common axis AA'. They are received with clearance in holes 14.0, 14.0' which serve as guide bushings. Locking elements 14, 14' are kept correctly centered along the contact axes AA' and in the holes 14.0, 14.0' by elastic rings 21, 21', 21", 21'". These elastic rings are, for example, open spirals made from spring steel. In order to position locking device 4 against locking projection 6, a first force or pressure is necessary for sliding inner bolts 14.2, 14.2' onto the outer borders of fixing recesses 6.0, 6.0'. This first force pushes the locking elements 14, 14' slightly to the exterior of case 4.0 and compresses elastic rings 21', 21" situated next to inner bolts 14.2, 14.2'. After having passed the outer borders of the fixing recesses 6.0, 6.0', elastic rings 21', 21" expand and inner bolts 14.2,14.2' weakly latch with locking projection 6. The clasp fastener is engaged and positioned. This first closing force or closure pressure can be regulated by different means. According to the preferred embodiments, a strip 400 of locking device 4 contacts a contact element, for example, lower strip 3 of the clasp. This force can be varied by using variable-diameter pins. The actuation of locking device 4 against locking projection 6 and the variation of actuation forces of the clasp will be described in detail in the description of the second preferred embodiment of a clasp fastener according to FIGS. 6*a*, 6*b* and 7.

FIG. 5*c* shows a third closure state wherein securing cover 5 is kept by a second snap engagement on locking device 4 (second closure stage). With reference to FIGS. 1*a*, 1*b* and 2 and to FIGS. 3*a*, 3*b* and 4*a*, 4*b* and 4*c*, securing cover 5 comprises two internal retaining recesses 20, 20' in side walls 22, 22' for engagement with outer bolts 14.1, 14.1' protruding through external walls of case 4.0. When securing cover 5 is closed over locking device 4, walls 22, 22' slide over outer bolts 14.1, 14.1' and push the locking elements 14, 14' slightly toward the interior of case 4.0. This second force is chosen to be stronger than the resisting force of elastic rings 21, 21', 21", 21'". As shown in FIG. 5*c*, two elastic rings 21, 21'" situated next to outer bolts 14.1, 14.1' are compressed and that elastic rings 21', 21" situated next to inner bolts 14.2, 14.2' are extended. Inner bolts 14.2, 14.2' lock the fixing recesses 6.0, 6.0' of locking projection 6. After locking of outer bolts 14.1, 14.1' by retaining recesses 20, 20', the elastic rings 21, 21', 21", 21'" expand weakly. This second force or pressure increases the snapping force of the clasp and allows a safety fastening. With the knowledge of the present invention, a person skilled in the art can implement other embodiments of recess surfaces for successive engagements of a clasp.

Figure 7:
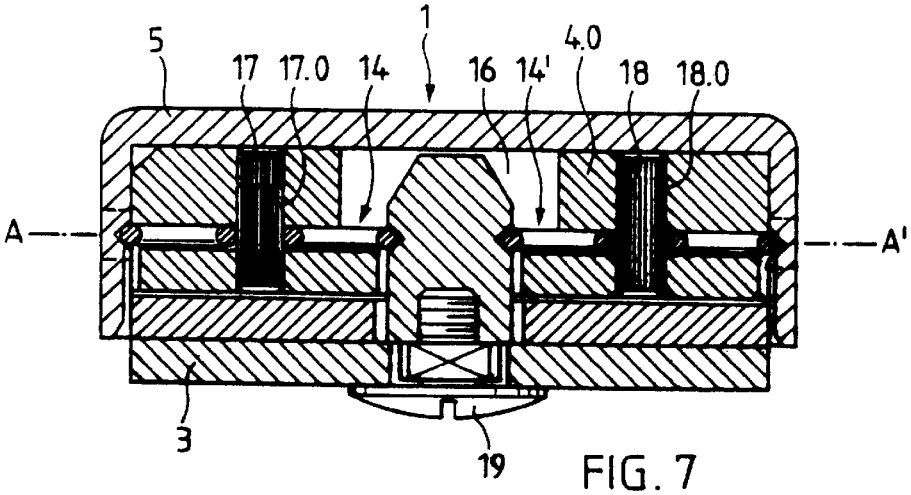
FIG. 7 is a transverse sectional view of a second preferred embodiment of a clasp fastener according to FIGS. 6*a* and 6*b.*
Figure 6B:
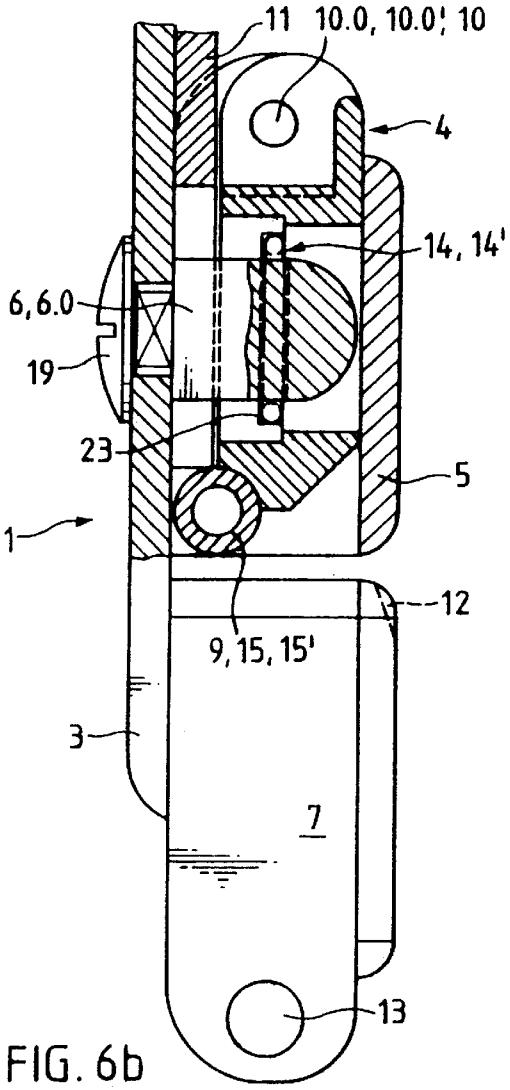
FIGS. 6*a* and 6*b* are a longitudinal view and sectional view of a second preferred embodiment of a clasp fastener.
Figure 6A:
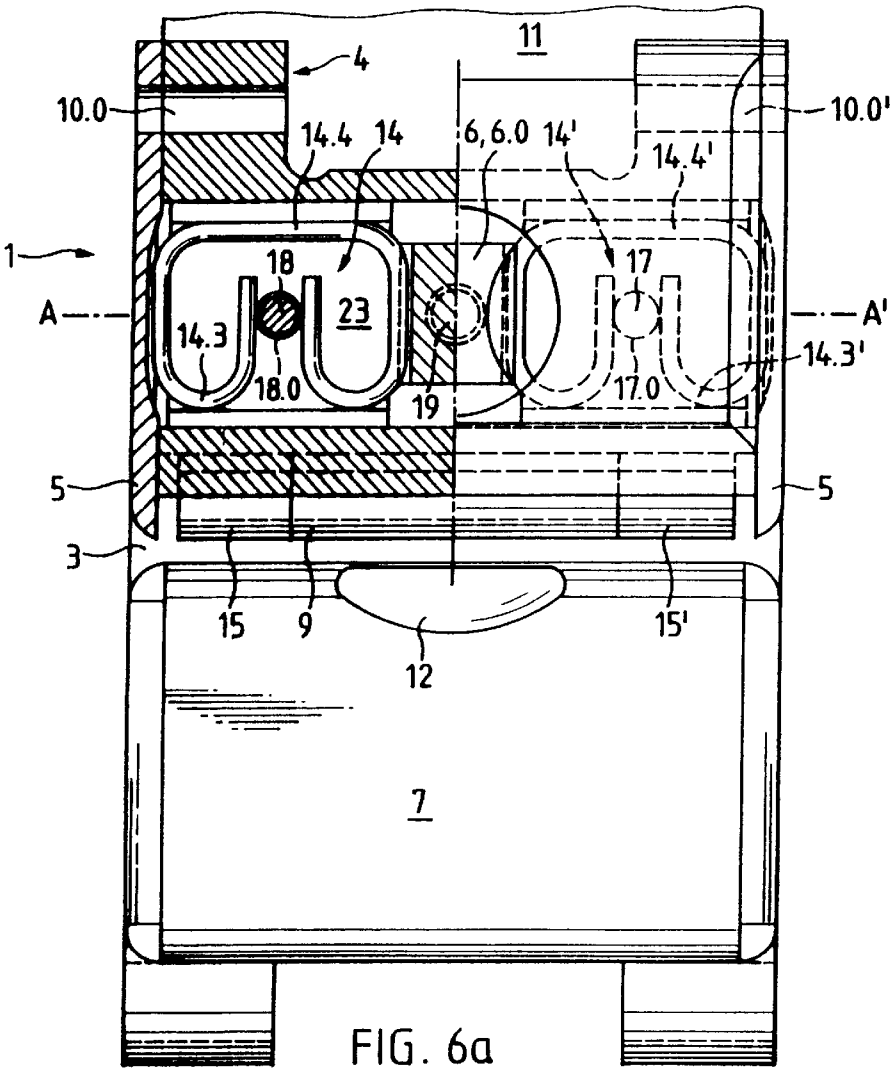

FIGS. 6*a* and 6*b* show a second preferred embodiment of a locking device 4 of a clasp fastener in a partly sectional outer plan view (FIG. 6*a*) and in a sectional side elevation (FIG. 6*b*). FIG. 7 is a transverse sectional view. Locking device 4 comprises essentially a case 4.0 with a central notch 16. Case 4.0 is penetrated by coaxial bore holes 17.0, 18.0 which perform a guide function for keeping variable-diameter pins 17, 18 along their axis. Moreover, case 4.0 has aligned through-holes 10.0, 10.0' for keeping along their axis a rod 10 of a hinge (see the description of FIGS. 1*a*, 1*b* and 2). According to a preferred embodiment, two guide bushings 15, 15' support a rod 9 of a hinge in a guide bushing 9.0 welded onto upper strip 11 of clasp 1. Two locking elements 14, 14' have the shape of elastic, auto-centered clips occupying a space 23 within locking device 4. Space 23 is adapted for retaining locking elements 14, 14'. Once locking device 4 is engaged with locking projection 6, the projection is within central notch 16 in engaged contact with locking elements 14, 14'. After elements 14; 14' protrude beyond two internal walls of locking device 4 in the area of contact with locking projection 6. With the knowledge of the present invention, a person skilled in the art can implement other locking elements having similar locking characteristics.

The mechanism of closure and opening of the second embodiment of locking device 4 differs slightly from the first embodiment with two locking elements 14,14' according to the description of FIGS. 5*a* to 5*c*. FIG. 7 shows a locking projection 6 screwed into lower strip 3 of the clasp and having two fixing recesses 6.0, 6.0' which are concave surfaces of the outer wall of locking projection 6. Fixing recesses 6.0, 6.0' serve to permit snap engagement of the rounded and convex portions of locking elements 14, 14' having the shape of elastic, auto-centered clips. Preferably, the concave surfaces of fixing recesses 6.0, 6.0' and the convex surfaces of the locking elements 14, 14' are shaped to match each other, having for example the same radius allowing optimized contact due to a maximal contact surface between these two elements. When locking device 4 is positioned against locking projection 6, a first force or pressure is necessary for pushing locking elements 14, 14' into recesses 6.0, 6.0'. Clasp 1 is engaged after this first closure stage. The safety closure occurs during a second closure stage, i.e., during a second snap engagement of securing cover 5 with locking device 4. With reference to FIGS. 1*a*, 1*b* and 2 and to FIGS. 3*a*, 3*b* and 4*a*, 4*b* and 4*c*, securing cover 5 is engaged with locking elements 14, 14' engagement of securing cover 5 with locking device 4, the walls of securing cover 5 are in engaged contact with locking elements 14, 14'. With the knowledge of the present invention, a person skilled in the art can implement other embodiments of elements of a clasp fastener. For example, it is possible to realize a clasp fastener having only one locking element.

According to the second embodiment, two locking elements 14, 14' each having the shape of an elastic, auto-centered clip, are curved supports, supporting along a contact axis AA' and being provided with curved and more flexible portions 14.3, 14.3' and with straight and more rigid portions 14.4, 14.4'. These supports have rounded surfaces. Locking elements 14, 14' are, for example, springs. The contacting force of locking elements 14, 14' is defined by the chosen dimensions (length, diameter, etc.) and by the materials chosen. Preferably, the spring-like locking elements 14, 14' have no tension in their uncompressed positions. After mounting in case 4.0 of the locking device 4, locking elements 14, 14' are guided in an adjustable manner by the walls delimiting space 23. The walls of case 4.0 being next to straight portions 14.4, 14.4' of locking elements 14,14' are, for example, guides. Under the influence of external pressures, locking elements 14, 14' are compressible/ extendible along their contact axis AA'. End portions of locking elements 14, 14' protrude beyond two external walls of locking device 4 on the sides of contact with securing cover 5, while end portions of locking which protrude through external walls of case 4.0 and are compressed. This second force is chosen stronger than the resisting force of locking elements 14, 14' for thereby increasing the pressure against locking projection 6 and allowing a safety closure. The totality of these forces or pressures is controllable and variable.

These forces or pressures can be regulated by different means. According to a preferred embodiment, case 4.0 contacts a contact element, for example, the lower strip 3 of the clasp. The closing force can be varied by means of variable-diameter pins 17, 18. According to one characteristic of the invention, these variable-diameter pins are adjustable by the choice of the used material, by the choice of the pin diameter, by the outer surface geometry, etc. These pins are, for example, soft or they have different diameters. FIG. 7 illustrates an example of two variable-diameter pins 17, 18, wherein the central diameter of variable-diameter pin 17 is smaller than the central diameter of variable-diameter pin 18. Locking element 14 is in contact with clearance with central diameter of variable-diameter pin 17, the locking element 14' is in contact with little or no clearance with the central diameter of variable-diameter pin 18. By a closing force, the diameter of variable-diameter pin 17 allows, therefore, a clearance for locking element 14, while the constant diameter of variable-diameter pin 18 allows little or no clearance with locking element 14'. Such a variation reduces the closing force effectively exerted on locking projection 6. With the knowledge of the present invention, a person skilled in the art can provide one or more locking elements having an equal closing force for the clasp.

As a result, the closing force of a clasp provided, for example, with a pair of variable-diameter pins 17 (allowing a high variation) is lower than the closing force of a clasp provided with a pair of variable-diameter pins 18 (allowing a low variation). By using pins 18 with a lower variation it is therefore possible to obtain models "Man" or "Sport" destined for male or sporting users are activated having a closing force higher than that of a model "Women" destined for female users and which are realized by using pins 17 with a reduced central diameter for a higher variation. The provision of one or more variable-diameter pins 17, 18 is not restricted to a clasp 1 according to the second embodiment of a locking device 4. This kind of application of variable-diameter pins is also and without any problems possible for a clasp 1 according to the first embodiment of a locking device 4.

The closing forces or pressures can be varied not only by using variable-diameter pins 17, 18 but they can also be varied by using other variation means. Another variation means represents the resisting force of locking elements 14, 14' exerted on securing cover 5 during a safety closure in a closure plane over a locking device 4. According to another characteristic of the invention, the orientation of locking elements 14, 14' in space 23 of the second embodiment of a locking device 4 is adjustable. Locking elements 14, 14' can, for example, be rotated by 180° in space 23. The latter must be designed in a symmetric manner in locking device 4. Such a 180° rotation allows variation of the mutual distances between straight portions 14.4, 14.4' of locking elements 14, 14' and hinge rod 10. These straight and rigid portions 14.4, 14.4' of locking elements 14, 14' constitute a resisting axis oriented more or less perpendicular to the closure plane of securing cover 5. The resisting force of rigid portions 14.4, 14.4' exerted on securing cover 5 is increased or reduced as a function of the size of the distance between hinge rod 10 and the resisting axis. By rotating locking elements 14, 14' in space 23, it is therefore possible to vary, i.e., to increase or to decrease the resisting force exerted on the safety closure of securing cover 5. A change in orientation of locking elements 14, 14' in space 23 according to FIG. 6*a* allows, therefore, a variation of the second snap engagement made by the securing cover 5. The first snap engagement made by the locking device 4 remains unchanged. The user can therefore adjust the safety force of clasp 1 in a free and rapid manner without consultation of a specialist, i.e., according to daily or leisure activities.

The visible elements of the clasp are preferably made from metal, for example, from stainless steel and/or gold. According to one characteristic of the invention, and with reference to the description of FIGS. 1*a*, 1*b*, 2, 6*b* and 7, locking projection 6 is mounted on lower strip 3 of the clasp preferably by welding or screwing. Other connection methods are naturally possible. Taking into account the high precision which is required for allowing easy and repeated operation of the clasp, and taking into account the difficulties resulting from the treatment of the chosen materials (reduced hardening after welding, asymmetric deformation after welding), preferably, welding is used for fixing a locking projection 6 made from gold on a lower strip 3 made from gold and screwing is used for fixing a locking projection 6 made from stainless steel on a lower strip 3 made from stainless steel. With the knowledge of the present invention, a person skilled in the art can provide fixation means for other base materials for example thermofusion for synthetic thermofusible materials.

What is claimed is:

1. A clasp fastener having a clasp (1) adapted to be closed in response to application of a closing force comprising a base having a locking projection;

a locking device (4) movable relative to said locking projection between an open position and a closed position;

said locking device including means for engaging said projection in said closed position with a latching force and being movable into said closed position by application of said closing force; and a securing cover (5) movable by said closing force to a safety position in which said cover engages said locking device (4) and increases said latching force of engagement of said means for engaging said locking projection (6).

2. The clasp fastener according to claim 1 wherein said means for engaging includes at least one locking pin (14, 14') movable with clearance along an axis (AA') to exert said latching force on said locking projection (6).

3. The clasp fastener according to claim 1 wherein said means for engaging includes at least one locking element (14,14') comprising an elastic, auto-centered clip compressible and extendible along a contact axis (AA') by said closing force and exerting said latching force on said locking projection (6).

4. The clasp fastener according to claim 3 wherein said means for engaging comprises at least one variable-diameter pin (17,18) allowing movement of at least one locking element (14,14') and reducing the effective latching force exerted on said locking projection (6).

5. The clasp fastener according to claim 2 wherein said locking device includes a case (4.0) and said at least one locking pin comprises outer bolts (14.1, 14.1') protruding through external walls of said case (4.0) of the locking device (4) in an area of contact with said securing cover (5), and inner bolts (14.2, 14.2') protruding through inner walls of said case (4.0) of the locking device in an area of contact with said locking projection (6).

6. The clasp fastener according to claim 5 comprising elastic rings (21, 21', 21", 21'") for centering locking elements (14, 14') along a contact axis (AA') and wherein holes (14.0, 14.0') in said case (4.0) are guide supports and wherein said elastic rings (21, 21', 21", 21'") are compressible and extendible allowing said locking elements (14, 14') to engage recesses (6.0, 6.0') in said locking projection (6).

7. The clasp fastener according to claim 5 wherein said locking elements (14, 14') are pushed by said closing force and by walls (22, 22') of said securing cover (5) toward an interior of said case (4.0) for engaging the locking elements (14,14') in said safety position in recesses (6.0, 6.0') in said locking projection (6) and in recesses (20, 20') in said securing cover (5).

8. The clasp fastener according to claim 3 wherein said securing cover (5) comprises walls defining an enclosed space (23) containing said at least one locking element, said walls guiding said at least one locking element (4) and wherein said at least one locking element has straight and rigid portions (14.4,14.4') defining a resisting axis resisting closure of said securing cover (5), said at least one locking element (14,14') protruding through outwardly facing walls of said case (4.0) in an area of contact with said securing cover (5), and said locking elements (14,14') protruding through inwardly facing walls of said case (4.0) in an area of contact with said locking projection (6).

9. The clasp fastener according to claim 8 wherein said at least one locking element is compressed by said closing force and by walls (22, 22') of said securing cover (5) into a safety position in recesses (6.0, 6.0') of said locking projection (6) and in recesses (20,20') of said securing cover (5).

10. The clasp fastener according to claim 8 wherein said securing cover (5) pivots around an articulation axis of a hinge and wherein a mutual distance between straight and rigid portions (14.4,14.4') of said at least one locking element and said hinge is adjustable by rotating said at least one locking element (14,14') in said space (23) for increasing or reducing the force resisting safety closure of said securing cover (5) over said locking device (4).

11. The clasp fastener according to claim 1 used for closing a clasp fastener of a wrist-watch strap comprising at least one of gold and stainless steel.

12. The clasp fastener according to claim 1 wherein said locking projection (6) is mounted on said lower strip (3) by welding or screwing.

* * * * *

UNITED STATES PATENT AND TRADEMARK OFFICE

CERTIFICATE OF CORRECTION

PATENT NO. : 6,073,316

DATED : June 13, 2000

INVENTOR(S) : Luigi Ferrario and Jacques Hubert Gay

It is certified that error appears in the above-indentified patent and that said Letters Patent is hereby corrected as shown below:

On the title page, Foreign Application Priority Data, item [30], should be changed from "Apr. 4, 1905" to -- Apr. 4, 1995 --.

Signed and Sealed this

Third Day of April, 2001

*Attest:*

Nicholas P. Godici

NICHOLAS P. GODICI

*Attesting Officer*

*Acting Director of the United States Patent and Trademark Office*